US005405218A

United States Patent [19]

Hyde-Smith

[11] Patent Number: 5,405,218

[45] Date of Patent: Apr. 11, 1995

[54] METHOD FOR THE REPAIR OF EXISTING MANHOLES USING ELASTOMERIC MATERIALS

[75] Inventor: Peter K. Hyde-Smith, Mayville, Mich.

[73] Assignee: Foamseal Inc, Oxford, Mich.

[21] Appl. No.: 878,943

[22] Filed: May 5, 1992

[51] Int. Cl.[6] ..... E02D 29/12

[52] U.S. Cl. ..... 405/303; 52/20; 56/187; 405/36; 405/52; 264/309

[58] Field of Search ..... 405/303, 150.2, 150.1, 405/146, 133, 268, 269, 270, 154, 156, 266, 267, 264; 52/20, 743, 744; 138/97; 156/294, 287; 264/31, 32, 34, 36, 309

[56] References Cited

U.S. PATENT DOCUMENTS

| | | | |
|---|---|---|---|
| 3,160,518 | 12/1964 | Jorda | 138/97 X |
| 3,287,148 | 11/1966 | Hilbush | 138/97 X |
| 3,356,777 | 12/1967 | Barrett | 264/36 |
| 3,440,086 | 4/1969 | Kerns . | |
| 3,871,583 | 3/1975 | Kellert | 239/302 |
| 3,905,945 | 6/1975 | Iseda et al. . | |
| 4,237,182 | 12/1980 | Fulmer et al. | 405/150.2 X |
| 4,291,069 | 9/1981 | Pilny | 405/264 X |
| 4,312,605 | 1/1982 | Clarke | 405/155 X |
| 4,331,722 | 5/1982 | Packo et al. | 405/264 X |
| 4,366,194 | 12/1982 | Pilny et al. | 405/270 X |
| 4,386,628 | 6/1983 | Stanley | 138/97 |
| 4,456,401 | 6/1984 | Williams | 156/294 X |
| 4,751,799 | 6/1988 | Ditcher et al. | 52/21 |
| 4,769,077 | 9/1988 | Crocker | 106/90 |
| 4,957,389 | 9/1990 | Neathery | 404/72 |
| 5,002,438 | 3/1991 | Strong | 405/303 |
| 5,017,313 | 5/1991 | Trimble | 264/32 |
| 5,032,197 | 7/1991 | Trimble | 156/71 |
| 5,063,967 | 11/1991 | Stephens | 138/98 |

OTHER PUBLICATIONS

Merck Index, 10th Ed.

"Utility Infrastructure Rehabilitation," U.S. Department of Housing and Urban Development, Office of Policy Development and Research.

*Primary Examiner*—Dennis L. Taylor

*Attorney, Agent, or Firm*—Howard & Howard

[57] ABSTRACT

This invention relates to a method of repairing existing manholes and similar structures by applying a fast-curing elastomeric material using spray techniques whereby a homogeneous, non-porous, and monolithic coating or lining is formed. The fast-curing elastomeric material can be applied directly to existing concrete, brick, tile, mortar, and metal surfaces normally found in sewer manholes and catch basins, sewer and drainage pipes, parking decks, bridge piers and footings, holding ponds, bridge trusses, culverts, gratings, and the like and does not require any formwork. The elastomeric coatings provide effective surface protection against wear, corrosion, and water infiltration and can be applied in a single operation to horizontal, vertical, and overhead surfaces. The elastomeric materials are prepared by initiating the reaction of an isocyanate-terminated compound or polymer with an amine-terminated polymer or an aliphatic or aromatic diamine immediately before applying the elastomeric material to the surface to be coated. Preferably the reactive components (i.e., isocyanate-containing and amine-containing materials) are mixed directly in the spray gun used to apply the elastomeric material.

25 Claims, 1 Drawing Sheet

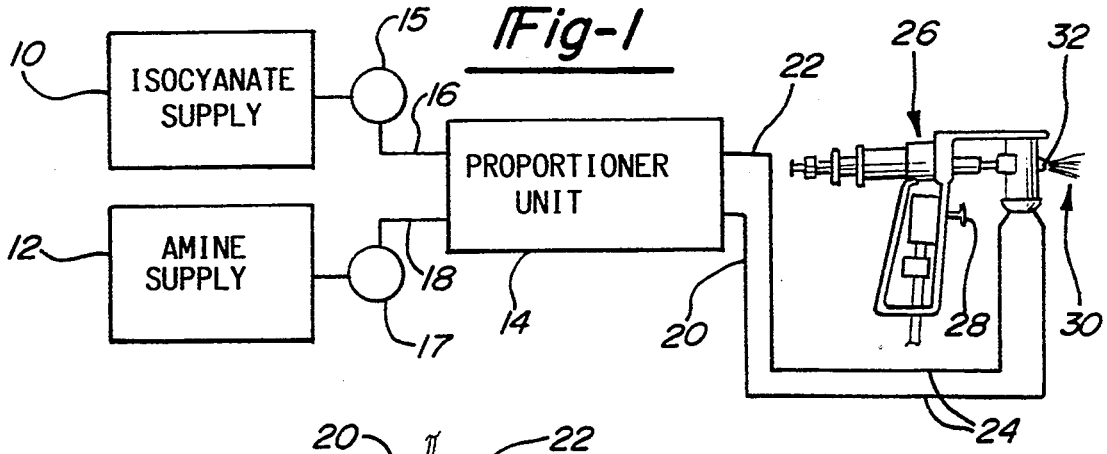
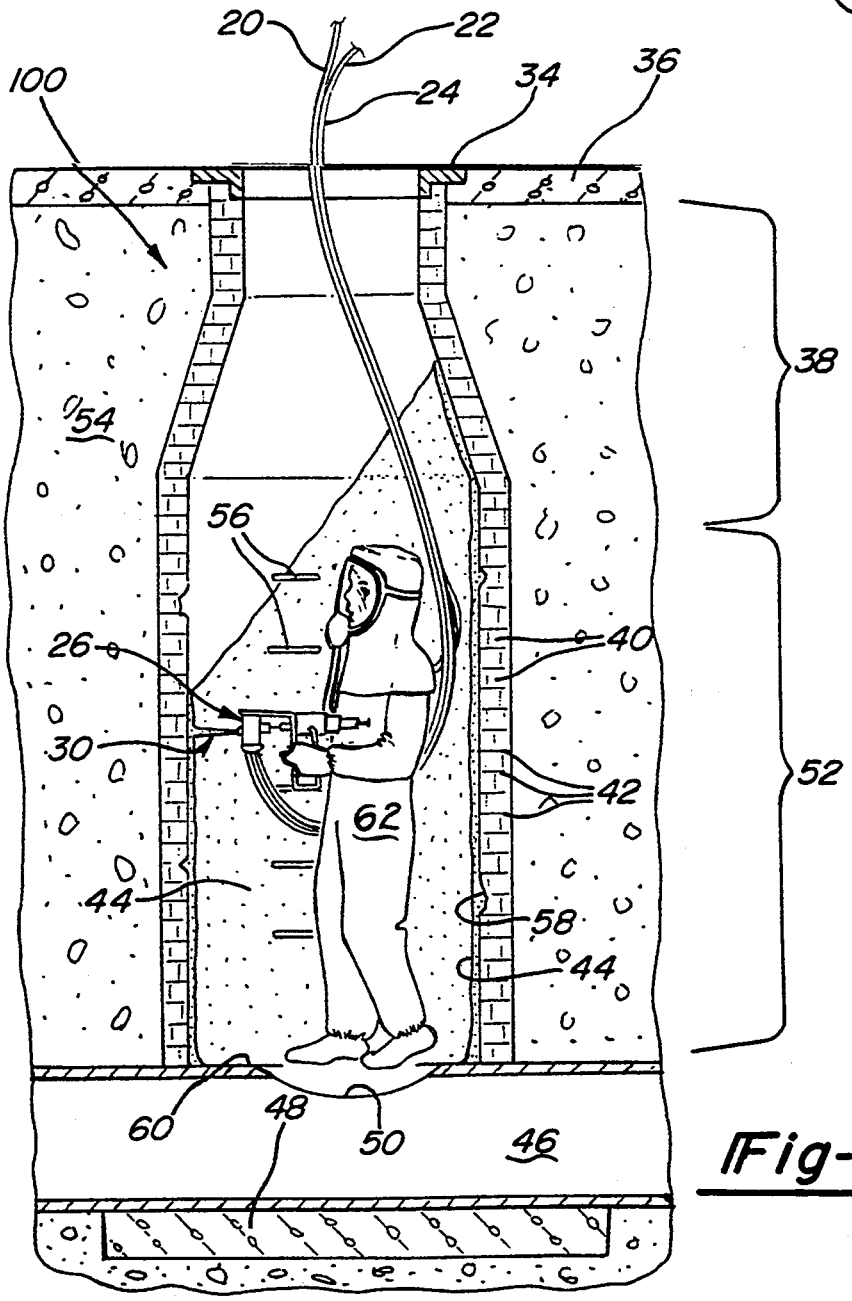
Fig-2

METHOD FOR THE REPAIR OF EXISTING MANHOLES USING ELASTOMERIC MATERIALS

BACKGROUND OF THE INVENTION

This invention relates generally to a method of repairing existing manholes and similar structures using elastomeric materials. More specifically, this invention relates to a method of repairing existing manholes and similar structures by applying a fast-curing elastomeric material using spray techniques whereby a homogeneous, non-porous, and monolithic coating or lining is formed. The fast-curing elastomeric material can be applied directly to existing concrete, brick, tile, mortar, and metal surfaces normally found in sewer manholes and catch basins, sewer and drainage pipes, parking decks, bridge piers and footings, holding ponds, bridge trusses, culverts, gratings, and the like and does not require any formwork. The elastomeric coatings of this invention provide effective surface protection against wear, corrosion, and water infiltration and can be applied in a single operation to horizontal, vertical, and overhead surfaces. The elastomeric materials used in the present invention are prepared by initiating the reaction of a isocyanate-terminated compound or polymer with an amine-terminated polymer or an aliphatic or aromatic diamine immediately before applying the elastomeric material to the surface to be coated. Preferably the reactive components (i.e., isocyanate-containing and amine-containing materials) are mixed directly in the spray gun used to apply the elastomeric material.

The repair and rehabilitation of the infrastructure in most of the industrialized world has become of increasing importance in recent years. The deteriorating infrastructure—including engineering structures such as sewer systems, water collection systems, bridges, culverts, catch basins, and the like—is becoming an ever increasing challenge to repair and maintain in a cost effective and timely manner. Of particular importance are the sewer systems—including both the lines and access manholes—in our older cities which may have been installed a century or more ago. Due to the location of many of these systems below ground, deterioration of the infrastructure is generally not readily apparent to the public until there is acute failure resulting in cracked pavement, collapsed streets, sewer backups, local flooding, low water pressure, or other severe problems. Also due to the underground location of these structures, complete replacement of the systems is very expensive as well as disruptive of human and economic activities above ground. If a sewer system is allowed to deteriorate until acute failures occurs, often the only method available to correct the problem is total replacement of the failed portion of the system. It is preferred, therefore, to apply preventive maintenance measures to such systems to prevent, or at least minimize, such acute failures and to maintain the operating capabilities of such systems. It is desirable, therefore, to provide methods by which such engineered structures can be repaired simply, effectively, with minimal downtime, and at a low-cost.

Several methods short of total replacement have been developed for tile repair or rehabilitation of existing structures such as sewer manholes. For example, U.S. Pat. No. 5,002,438 provides for the repair of existing manhole structures by the spray application of a cementitious mixture to the interior of the manhole structure to form a liner. Two to five hundred pounds of the cementitious mixture is generally required to repair a typical manhole structure. And such a liner can only be put back into service after the cement mixture sets. A booklet published by the U.S. Department of Housing and Urban Development entitled "Utility Infrastructure Rehabilitation" (Nov. 1984) ("Booklet") also presents several methods that are reportably useful in such rehabilitation efforts. These methods include (1) coatings (such as epoxy, acrylic, or polyurethane) applied to the interior walls of the manhole, (2) chemical grouts injected into the surrounding ground from the interior of the manhole, and (3) structural liners (e,g., a fiberglass liner) inserted inside the manhole. Booklet at 5–57 to 5–58. None of these methods have proven to be completely satisfactory. For example, although it is known to apply polyurethane coatings with a airless sprayer, the surface to be coated by be "very clean, free of debris, structurally sound, dry." Id. at 5–57. For structurally damaged or disintegrated manhole structures (i.e., the structures most in need of repair and most likely to be found in the sewer systems of our older cities), only the structural liners are reported to be useful. Id, at 5–59. Thus, additional methods are needed to repair and rehabilitate existing manholes, especially structurally damaged or disintegrated manhole structures. It would be desirable to provide a relatively simple and quick method for the repair or rehabilitation of both structurally sound manholes and structurally damaged or disintegrated manholes. It would also be desirable if such a method used a minimum of materials and if the repaired manhole could be returned to service almost immediately. It would also be desirable if such a method could be used on both the brick and mortar interior surfaces as well as on metal surfaces commonly found in manholes. The present invention provides such a method. Other advantages and benefits of the present invention will become apparent upon a review of the specification.

SUMMARY OF THE INVENTION

The present invention relates to a method of repairing existing manholes and similar structures by applying a fast-curing elastomeric material using spray techniques whereby a homogeneous, non-porous, and monolithic coating or lining is formed. The fast-curing elastomeric material can be applied directly to existing concrete, brick, tile, mortar, and metal surfaces normally found in sewer manholes and catch basins, sewer and drainage pipes, parking decks, bridge piers and footings, holding ponds, bridge trusses, culverts, gratings, and the like. The elastomeric coatings of this invention provide effective surface protection against wear, corrosion, and water infiltration and can be applied in a single operation to horizontal, vertical, and overhead surfaces. The elastomeric materials used in the present invention are polyureas prepared by initiating the reaction of a isocyanate-terminated compound or polymer with an amine-terminated polymer or an aliphatic or aromatic diamine immediately before applying the elastomeric material to the surface to be coated. Preferably the reactive components (i.e., isocyanate-containing and amine-containing materials) are mixed directly in the spray gun used to apply the elastomeric material. By varying the two reactive components, the properties of the elastomeric material can be varied and adjusted for the intended application.

The present invention provides an easy, relatively inexpensive, and effective method to line or reline engineering structures constructed of brick, tile, concrete block, concrete, mortar, metal, and like materials of construction. Because the elastomeric material is applied with spray techniques and is fast curing, formwork is not required and the materials can be applied to horizontal, vertical, and overhead surfaces with minimal dripping or wasted material. Due to the easy of application, the thickness of the applied elastomeric coating or lining can be widely varied depending on the intended application. Thinner coatings (i.e., about 0.05 to 0.25 inches) can be used where only a sealing coating is required. Thicker coatings (i.e., 0.25 to 0.75 inches) may be used for increased structural reinforcement as well as sealing. Even thicker coatings may be used in local areas for patching (e.g., plugging holes left by missing bricks) before the general monolithic coating is applied. Using the elastomeric material as such a patching material can significantly reduce the time necessary for repairing a badly damaged or deteriorated manhole.

One object of the present invention is to provide a method for lining or relining an existing engineering structure to rehabilitate, reinforce, and protect the engineering structure, said method comprising (1) preparing the surface of the engineering structure to be lined or relined by cleaning the brick, tile, concrete block, concrete, mortar, or metal forming the surface and removing loose particles of brick, tile, concrete block, concrete, mortar, or foreign material from the surface;

(2) applying a fast-curing elastomeric material to the prepared surface of the engineering structure to be lined or relined by spraying the fast-curing elastomeric material onto the prepared surface whereby a monolithic, continuous elastomeric coating is formed on the prepared surface, wherein the fast-curing elastomeric material is prepared by rapidly mixing and initiating the reaction of an isocyanate-terminated compound-containing mixture and an amine-terminated compound-containing mixture immediately before spraying the fast-curing elastomeric material onto the prepared surface;

(3) allowing the fast-curing elastomeric coating to cure, whereby an elastomeric liner is formed on the prepared surface to rehabilitate, reinforce, and protect the engineering structure.

Another object of the present invention is to provide a lined manhole forming a portion of a sanitary or non-sanitary sewer system and buried below ground layer, said lined manhole comprising (1) a housing with an interior surface formed of brick, tile, concrete block, concrete, or mortar having an interior space to allow human access to a buried conduit forming a portion of the sanitary or non-sanitary sewer system wherein the housing is adapted to be buried in the ground; and (2) a sprayed elastomeric liner within the interior of the housing forming an essentially continuous, non-porous, monolithic liner formed in place and substantially conforming to the geometry of the interior of the housing, wherein the sprayed elastomer liner is formed from a fast-curing elastomeric material sprayed onto the interior surface of the housing and wherein the fast-curing elastomeric material is the reaction product of an isocyanate-terminated compound and an amine-terminated compound.

These and other objects and advantages of the present invention will become apparent upon a consideration of the following figures and description of the preferred embodiments.

BRIEF DESCRIPTION OF THE DRAWINGS

FIG. 1 provides a schematic representation of an apparatus suitable for applying the elastomeric materials of the present invention.

FIG. 2 illustrates the application of the elastomeric materials of the present invention in a typical manhole structure.

DETAILED DESCRIPTION OF THE PREFERRED EMBODIMENTS

This invention relates to a fast-curing elastomeric material which can be sprayed onto surfaces normally found in engineering structures to form a homogeneous, monolithic, and non-porous liner. Engineering structures which can be treated by the method of this invention include existing sewer manholes and catch basins, sewer and drainage pipes, parking decks, bridge piers and footings, holding ponds, bridge trusses, culverts, gratings, and the like which have surfaces of concrete, brick, tile, mortar, metal, and the like. Manholes normally found in sanitary and non-sanitary sewer systems are especially preferred structures for lining or relining by the method of this invention.

The elastomeric material of the present invention is prepared by reacting an isocyanate-terminated compound or polymer containing at least two reactive isocyanate groups with an amine compound containing at least two reactive amine groups. The two reactive components are mixed immediately before being spray applied to the surface to be coated. FIG. 1 is a schematic representation of an apparatus suitable for applying the elastomeric coating of the present invention. A source of the isocyanate-terminated compound 10 and a source of the amine-containing compound 12 are separately connected to a the control unit 14 by lines 16 and 18, respectively. Pumps 15 and 17 are located in lines 16 and 18, respectively, to transfer the liquid reactants to the control unit 14. The control unit 14 allows precise and accurate control of the relative amounts, temperatures, and pressures of two reactants fed to the spray gun 26. The isocyanate-terminated compound from source 10 is fed through line 16 by pump 15 into control unit 14 and then through line 22 to spray gun 26. The amine-containing compound is similarly fed from source 12 through line 18 by pump 17 into control unit 14 and then through line 20 to spray gun 26. Preferably, lines 20 and 22 are physically connected or bundled (i.e., bundled line 24) at some point after exiting from the control unit 14 to minimize tangling of the separate lines. The bundled line 24 is connected directly to the spray gun 26 which is equipped with a trigger 28 to activate the spraying action and a nozzle 32. The sprayed fast-curing elastomeric material 30 is applied directly to the surface to be coated.

Because of the very reactive components used and the fast-curing nature of the elastomeric material formed from the reactive components, the reactive components are preferably mixed directly in the spray gun 26. Suitable spray guns are commercially available. One especially preferred spray gun is a Model GX7 spray gun from Gusmer of Lakewood, N.J. The control unit 14 is also commercially available. Especially preferred control units include the H-2000 proportioner unit from Gusmer and tile FS2000 proportioner unit from, Foamseal of Oxford, Mich. These units can typically supply and deliver about 10 to 30 pounds of material per minute at a pressure of about 1000 to 3500 psi. Generally, an output rate of about 15 to 25 pounds/minute at about 1200 to 2500 psi is preferred. Both of these proportioners include pumps and temperature and pressure controls for accurate metering and control of the raw materials to the spray gun. Pumps 15 and 17 used to transfer reactants to the control unit 14 are also commercially available. Preferred pumps 15 and 17 include air-driven 2:1 transfer pumps from Gusmer. Preferably, reactant supplies, transfer pumps, and the control unit are located on a mobile trailer or truck bed (not shown) to allow easy movement to the manhole or other engineering structure to be lined.

FIG. 2 shows a manhole 100 being lined by the method of the present invention. Manhole 100 has a frame 34 (usually metal) for receiving the manhole cover (not shown) and allowing access to the interior of the manhole. The frame 34 is level with the ground or roadbed 36. The upper portion 38 (often referred to as the chimney) and the lower, vertical portion 52 (generally of uniform diameter) are constructed of bricks 40 and mortar joints 42 bonding the bricks together. The manhole 100 is buried below the ground or roadbed surface 36, is buried within and contacts the ground 54, and generally rests upon a concrete base 48. The bottom 60 of the manhole is intersected with an opening 50 in the sewer conduit 46 through which water flows. The manhole 100 has metal ladder rungs 56 which allow easy entry and exit for the workperson 62. As shown in FIG. 2, the workperson 62 is applying elastomeric material 46 to the interior surfaces of the lower portion 52 from the spray gun 26. The spray gun 26 is connected via bundled transfer line 24 (containing separate isocyanate supply line 22 and amine supply line 20) to the control unit 14 (not shown) on the surface. The isocyanate reactant and the amine reactant are mixed in the spray gun 26 and then sprayed 30 upon the interior surfaces, including the metal step rungs 56, to form a homogenous, monolithic, non-porous liner that conforms to the configuration of the interior portion and covers the brickwork 40 and the mortar 42. The elastomer material can also be used to patch large voids 58 in the brickwork (e.g., where a portion or an entire brick is missing). In FIG. 2, the lower portion 52 and the bottom 60 have been lined with elastomeric material 44. To complete the job, the workperson 62 will simply continue spraying the elastomer material 30 onto the upper surfaces 38 and at least a portion of the metal frame 34 until the interior surfaces of the manhole are coated to the desired thickness.

One advantage of the present method is that the elastomeric material can be applied to horizontal, vertical, and overhead surfaces without significant dripping or sagging. Thus, the workperson 62 in FIG. 2 can easily coat the upper, overhead portions 38 of the manhole while standing on the bottom 60 or, if desired, elevated on the ladder rungs 56. Of course, the workperson 62 could, if desired, complete the coating of the upper portion 38 from ground level. Another advantage of the present method is that the equipment used to apply the elastomeric material (i.e., spray gun 26 along with bundled supply lines 24) are very lightweight and easily maneuverable and can, therefore, be used to coat overhead surfaces with minimal worker fatigue. Still another advantage of the present invention is the rapid curing of the elastomeric material. Not only can the manhole or other engineering structure be put back into operation quickly, but the operator can walk on the cured material within a matter of minutes. Thus, the workperson 62 in FIG. 2 could spray a portion of the bottom 60 and the adjacent vertical surfaces of the manhole and then after only a few minutes stand on the portion of the bottom already coated to finish the application on the remainder of the bottom and interior surfaces. Likewise, ladder rungs 56 can be sprayed and then used to exit the manhole after only a few minutes. Another advantage of the present invention is the speed in which a manhole can be rehabilitated. A typical manhole (i.e., ten feet deep and four feet in diameter) can normally be sprayed, and therefore rehabilitated and lined, with the elastomeric material of this invention in thirty minutes or less and put back into service immediately. Of course, badly deteriorated structures where significant patching or other repair work is necessary will be expected to take longer. Still another advantage of the present invention is that because metal surfaces can be coated by the elastomeric materials of this invention, it is not necessary to remove ladders or other metal structures prior to applying the coating material. In addition, by coating both the brick, mortar, and metal surfaces in a single operation, a monolithic surface is formed on those surfaces and the interfaces and joints between the dissimilar substrate surfaces thereby providing even more protection. And because of the elastomeric nature of the coating, the liner is essentially unaffected by thermal cycling of the structure (especially at the interfaces of the dissimilar substrates) caused by variation of the ambient temperature.

Before the elastomeric material of the present invention is applied, it is generally desirable to prepare the surface to be repaired. The extent of the preparation will, of course, depend largely upon the condition of the surfaces and the presence, if any, of contaminants on the surface or within the interior of the manhole. Cleaning and preparation can be carried out by any conventional means such as water or steam spraying and cleaning including the use, if appropriate, of detergents or surfactants. Such preparation should remove loose materials such as broken bricks, loose mortar, and loose paint or rust on any metal surfaces. Structural repairs or modifications, if needed, should be performed prior to application of the elastomer material. Voids (e.g., missing bricks or mortar) can be filled with mortar or concrete patching material or, if desired, with the same elastomeric material used to form the elastomeric liner or coating. In applying the elastomer materials of this invention it is not necessary for the surfaces to be coated to be absolutely dry. Excess moisture (i.e., water droplets on the surface or standing water in the bottom) should be removed before application. Removal of such excess water can be affected, for example, with compressed air, heated air ducted into the manhole, or simply allowing the water to evaporate.

Although the elastomeric materials of this invention can be applied year round, better results are generally obtained at ambient temperatures of about 0° to 150° F. Largely for convenience, ambient temperatures of 65° or higher are preferred. Generally, substrate temperatures of about 40° to 200° F. are acceptable. Typically, substrate temperatures are normally in the range of about 55° to 75° F. depending on the season. The temperature of the isocyanate-containing and amine-containing reactants are generally in the range of about 100° to about 200° F. and are preferably in the range of about 130° to 180° F. and are more preferably in the range of about 150° to 160° F. At lower ambient or substrate temperature it may be preferred to employ the reactants at a temperature at the higher end of the range. Although it is generally preferred that the two reactants be at roughly the same temperature when mixed and reacted, it is not necessary. And although it is generally preferred that the relative amounts of the two reactants are essentially 1 to 1 (by either volume or weight depending on whether the actual control units use volume or weight control parameters), it is not necessary. The relative ratio of 1 to 1 for the reactants allows for easier adjustment and control of the process. However, other relative ratios can be used so long as tile resultant elastomeric material has the necessary properties.

The elastomeric material of the present invention is prepared by mixing and reacting an isocyanate-terminated compound or polymer with an amine-terminated polymer or an aliphatic or aromatic diamine compound and then essentially immediately applying the resultant reacting mixture to the surface to be coated and repaired. Preferably the mixing of the two reactants is effected directly within the spray gun used to apply the mixture (i.e., impingement mixing).

Suitable isocyanate-terminated compounds or polymers must have at least two terminal isocyanate groups and may be either aliphatic or aromatic in nature. The isocyanate-terminated compounds suitable for use in this invention have mean functionality of about 2 to 3.2 and contain about 15 to 35 weight percent isocyanate groups. Preferred isocyanate-terminated compounds are based on, or derived from, methylene diphenyl diisocyanate. Preferred isocyanate-terminated compounds are of the monomers or polymers of the general formula I

I

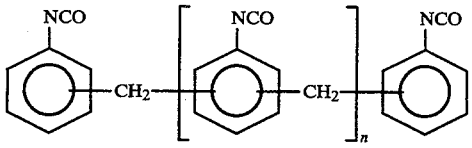

where n is an integer from 0 to about 10 and preferably from 0 to about 4. The isocyanate-terminated compound I is me thylene diphenyl diisocyanate when n is zero and is a polymeric methylene diphenyl diisocyanate when n is greater than zero. Mixtures of the compounds I can also be used. In fact, a mixture containing compound I where n equals 0, 1, 2, and 3, (and perhaps with lesser amounts of compounds where n is greater than 3) is one preferred isocyanate-terminated compound. Preferably compound I is, when n equals 0, the 4,4'-methylene diphenyl diisocyanate. Often, the 4,4'-methylene diphenyl diisocyanate will contain a small amount of the 2,4'-isomer (i.e., 2,4'-methylene diphenyl diisocyanate). Compound I with n greater than or equal to 1 is a linear polymer. As those skilled in the art will realize, branched polymers can also be used where methylene phenyl isocyanate groups are attached directly to one or both of the phenyl rings in the methylene diphenyl diisocyanate structure. Mixtures of such linear and branched polymers can also be used. Other preferred isocyanate-terminated compounds are quasi-prepolymers of the general formulas II and III:

II

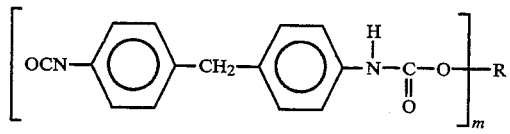

III

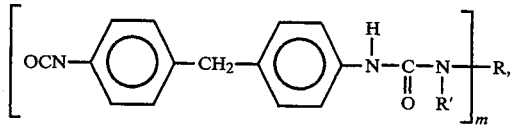

where m is equal to 2 or 3, R' is a hydrogen or an aliphatic radical (e.g., methyl or ethyl radical), and R represents an aliphatic polyether. The polymer II is an isocyanate-terminated quasi-prepolymer prepared by reacting a polymer as defined in formula I with a dihydroxyl-terminated or a trihydroxyl-terminated polyol. The polymer III is an isocyanate-terminated quasi-prepolymer prepared by reacting a polymer as defined in formula I with a diamine-terminated or a triamine-terminated polyether. Generally, quasi-prepolymers of general formula II are preferred. Especially preferred polyols are the aliphatic polyether polyols. For example, reacting a hydroxyl-terminated polyether (HO OH) with methylene diphenyl diisocyanate yields a isocyanate-terminated prepolymer as illustrated in the following equation:

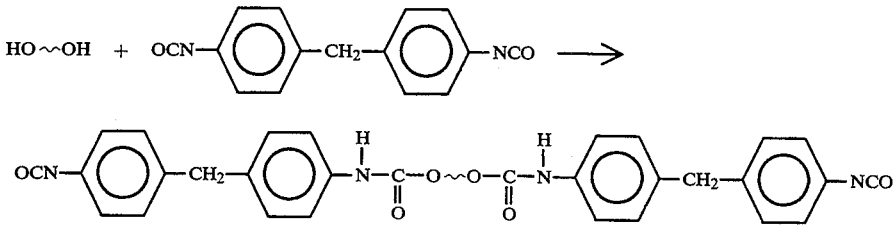

where represents the aliphatic polyether portion. Similarly, a polyether diamine could be reacted with methylene diphenyl diisocyanate. Examples of such aliphatic polyether groups include the following:

$$-CH_2\underset{\underset{R''}{|}}{CH}\left[OCH_2\underset{\underset{R''}{|}}{CH}\right]_x OCH_2\underset{\underset{R''}{|}}{CH}-,$$

$$-CH_2CH_2CH_2\left[OCH_2CH_2CH_2\right]_x OCH_2CH_2CH_2-, \text{ and}$$

$$-CH_2CH_2CH_2CH_2\left[OCH_2CH_2CH_2CH_2\right]OCH_2CH_2CH_2CH_2-$$

and the like, where each R'' is independently a hydrogen or a methyl radical. Thus, these polyether compounds are based on the polymerization of ethylene oxide, propylene oxides, butylene oxides, and the like. Preferably, x has an average value such that the molecular weight of the polyol portion is in the range of about 900 to 6000, and more preferably in the range of about 2000 to 6000.

The quasi-prepolymers are prepared by reacting an excess of methylene diphenyl diisocyanate with a polyether polyol (terminated with either two or three hydroxyl groups) or the polyether amine (terminated with either two or three reactive amine groups, preferably primary amine groups) to obtain a liquid quasi-prepolymer. Generally an equivalent ratio for the reactants (as expressed in terms of —NCO to —OH or —NCO to —NH) of about 2 to 1 or greater, respectively, is acceptable although the equivalent ratio of the reactants and the reaction conditions can be varied so long as the resultant quasi-prepolymer remains liquid at, or slightly above, room temperature. The quasi-prepolymers must contain sufficient free isocyanate groups to react with the amine-terminated compounds when the actual elastomeric material is applied to the surface (e.g., manhole) to be repaired. As the equivalent ratio of the reactants approaches about 1 to 1, solid quasi-prepolymers may result; such solid quasi-prepolymers would not be useful in the practice of this invention and should, therefore, be avoided. Two general methods have been found useful in the preparation of the quasi-prepolymers. In the first, the reactants are simply mixed together and reacted at a temperature from about room temperature to 140° F. for a time sufficient to prepare the desired quasi-prepolymer. The time required will, of course, depend on the reaction temperature; generally an overnight reaction time will be sufficient. This first method is especially adapted for use in the present invention in that the reactants can simply be combined in a suitable container (e.g., a 55 gallon drum) and the quasi-prepolymer will be ready to use the next morning. The quasi-prepolymers can also be prepared in a more controlled manner by adding the polyether polyol or the polyether amine slowly to the diisocyanate at the reaction temperature (room temperature to about 140° F.) so as to insure a large excess of tile diisocyanate during the reaction. Using either method, solvent is not required. In some cases, cooling of the reactants may be desirable in order to control the exotherm. Generally, such cooling is not needed at the lower reaction temperatures.

Isocyanate-terminated polymers suitable for use in the present invention are generally available commercially. Examples of such commercially available materials include isocyanates such as PAPI94 from Dow Chemical Company, MRS Series isocyanates from Miles Inc., and Mondur 1424 from Miles, Inc.; uretonimine modified methylene diphenyl diisocyanates such as Mondur CD from Miles, Inc., Isonate 143L from Dow Chemical Company and LF-168 from ICI Americas, Inc.; quasi-prepolymers prepared from methylene diphenyl diisocyanates such as Mondur PF from Miles, Inc., Isonate 181 from Dow Chemical Company, LF-179 from ICI Americas, Inc.. Other commercially available isocyanate-terminated polymers may also be used. Examples of polyether polyols useful in preparing quasi-prepolymers of the present invention include PolyG 30-28, PolyG 85-36, PolyG 85-29, PolyG 76-120, PolyG 55-28, PolyG 55-56, and PolyG 20-56 from Olin Corporation. Especially preferred polyether polyols are the ethylene oxide-capped polyether diols and triols. Similar polyether polyols from other suppliers may also be used to prepare the quasi-prepolymers.

As noted above, the elastomeric material of the present invention is prepared by mixing and reacting an isocyanate-terminated compound with an amine compound containing at least two reactive amine groups wherein the mixing and reacting occurs immediately before the application to the surface to be repaired. The amine compound can be aliphatic or aromatic. The reactive amine can be a primary or a secondary amine. The amine-terminated compounds suitable for use in this invention generally have a mean functionality of about 2.0 to 3.0 and an average molecular weight of about 150 to 6000. Preferred amine compounds include amine-terminated polymers and aliphatic or aromatic diamines. Preferred amine-terminated polymers are the polyoxyalkyleneamines having primary amino groups attached to the terminus of polyether backbones (i.e., polyether amines). Examples of preferred aliphatic amine-terminated polymers include polymers of general formula IV $$H_2N-CH_2\underset{\underset{R''}{|}}{CH}+OCH_2\underset{\underset{R''}{|}}{CH}\underset{x}{]}OCH_2\underset{\underset{R''}{|}}{CH}-NH_2 \qquad \text{IV}$$

where each R″ is independently hydrogen or a methyl radical. Preferably, R″ is a methyl radical and the average value of x is in the range of about 2 to 105 which corresponds to an average molecular weight of about 230 to 6000. An example of such an aliphatic amine-terminated polymer is the Jeffamine D-2000 amine-terminated polypropylene glycol from Texaco Chemical Co. where in the above formula IV, R″ is a methyl group, x has an average value of about 33, and the molecular weight is about 2000.

Trimnine polymers can also be used. Examples of preferred aliphatic triamine-terminated polymers include polymers of general formula V $$\begin{array}{l} CH_2+OCH_2CHR'')_a-NH_2 \\ | \\ CH+OCH_2CHR'')_b-NH_2 \\ | \\ CH_2+OCH_2CHR'')_c-NH_2 \end{array} \qquad \text{V}$$

where R″ is hydrogen or a methyl radical. Preferably R″ is a methyl radical and a, b, and c are independently in the range of about 0 to about 100 and such that the average molecular weight is in the range of from about 260 to about 6000. Specific example of such triamine-terminated polymers include Jeffamine T-3000 (average molecular weight of 3000 and containing about 50 moles of polypropylene oxide) and Jeffamine T-5000 (average molecular weight of about 5000 and containing about 85 moles of polypropylene oxide) from Texaco Chemical Company.

Examples of suitable aliphatic amines include bis(-para-aminocyclohexyl)methane and mixed polycycloaliphatic amines (both commercially available from Air Products and Chemicals, Inc.) Examples of suitable aromatic include amines include 3,5-diethyltoluene-2,4-diamine, 3,5-diethyltoluene-2,6-diamine, and mixtures thereof (commercially available as Ethacure 100 from Ethyl Corporation); para-di(N-alkyl)amine benzene (commercially available as Unilink 4100 from UOP); and 4,4′-methylene diphenyl di(N-alkyl)amine (commercially available as Unilink 4200, Unilink 8100, and Unilink 8130 from UOP). Oligomeric diamines (i.e., polytetramethyleneoxide di-p-aminobenzoate) such as Polamine-650, Polamine-1000, and Polamine-2000 from Air Products and Chemicals, Inc. can also be used.

Of course, mixtures of suitable isocyanate-terminated compounds and mixtures of suitable amine-terminated compounds can be used and are often preferred. Generally equivalent amounts (i.e., 1 to 1 ratios based on the reactive isocyanate and amine contents) of the isocyanate material and the amine material are mixed directly in the spray gun and the resultant reacting mixture is applied to the manhole surfaces to be coated. Various additives can be included in the isocyanate reactants and/or the amine reactants. For example, organic or inorganic colorants can be added to either reactants. It may be generally preferred, however, that organic dyes only be incorporated in the isocyanate reactants in order to avoid possible side reactions with the amine compounds. By using colored dyes or colorants, the effectiveness of the mixing in the spray gun and application on the manhole surfaces can be determined visually: an elastomeric material of uniform color will generally indicate acceptable mixing and proper operation of the spray equipment. Examples of suitable dyes or colorants include 57AB Black, X17AB Blue, X38 Orange, X52 Red, and X15 Yellow from Milliken Chemical. Other commercially available dyes or colorants can be used so long as they are compatible with the reactants and other components.

Other additives, including light stabilizers, UV absorbers, anti-oxidants, adhesion promoters, and other processing aids or enhancers, can also be employed. Generally it is preferred to incorporate such additional components into the amine reactants. Examples of suitable light stabilizers include hindered amines such as Tinuvin 765 (bis (1,2,2,6,6-pentamethyl-4-piperidinyl) sebacate) and Tinuvin 770 (bis (2,2,6,6-tetramenthyl-4-piperidyl) sebacate) from Ciba-Geigy. Examples of suitable UV light absorbers include Tinuvin 328 and Tinuvin 571 from Ciba-Geigy (both are substituted benzotraiazoles). Examples of suitable antioxidants and thermal stabilizers include Irganox 259 (hexamethylene bis (3,5-di-tert-butyl-4-hydroxyhydro cinnamate), Irganox 1010 (tetrakis [methylene (3,5-di-tert-butyl-4-hydoxyhydro cinnamate)] methane), and Irganox 1330 (1,3,5-trimethyl-2,3,6-tris (3,5-di-tert-butyl-4-hydroxybenzyl) benzene) from Ciba-Geigy. Examples of adhesion promoters include titanares and zirconates such as NZ 37 (zirconium IV 2,2-(bis-2-propenolatomethyl) butanolato, tris (4-amino) benzoato-0), NZ 44 (neopentyl(diallyl)oxy tri(m-ethylenediamoino) ethyl zirconate ) and LICA 97 (neopentyl (diallyl)oxy tri(m-amino)phenyl titanate) from Kenrich Petrochemicals. Various organofunctional silanes (especially the amino-functional silanes) may also be effective adhesion promoters. Light stabilizers, if used, will normally be present at about 0.2 to 0.75 weight percent in the amine reactants. UV light absorbers, if used, will normally be present at about 0.2 to 0.75 weight percent in the amine reactants. Antioxidants or thermal stabilizers, if used, will normally be present at about 0.1 to 0.5 weight percent in the amine reactants. Adhesion promoters, if used, will normally be present at about 0.05 to 0.2 weight percent in the amine reactants. Other conventional light stabilizers, UV light absorbers, antioxidants, thermal stabilizers, and adhesive promoters can also be used in place of, or in addition to, the specific examples given.

The following examples are intended to further illustrate the invention and not to limit the invention. Unless specified otherwise, all percentages in the following examples are by weight.

EXAMPLE 1

A 10-foot deep and 3.5-foot diameter block manhole in Thornton, Ill. was used to test the effectiveness of this invention. This manhole was in relatively good condition with no missing blocks and relatively little missing mortar. The ambient temperature was about 75° F. The manhole was first cleaned with high-pressure water to remove loose debris from the walls, bench, chimney, corbel, and metal frame. The surfaces were then dried with high-pressure air to remove surface moisture. The isocyanate reactant consisted of a quasi-prepolymer prepared by reacting an isocyanate (PAPI 94 from Dow Chemical) with a trihydroxyl-terminated ethylene oxide-capped polyether with a molecular weight of about 1400 (PolyG 76-120 from Olin Chemicals). The isocyanate and the polyether (70 to 30 weight ratio) were simply mixed together and allowed to react at about 110° F. for about 24 hours. The amine reactant consisted of a polymeric aliphatic triamine (39.8%; Jeffamine T-3000 from Texaco), a polymeric aliphatic diamine (15.0%; Jeffamine D-2000 from Texaco), three aromatic diamines (15% of Ethacure 100 from Ethyl Corporation, 20% of Unilink 4100 from UOP, and 10% of Unilink 4200 from UOP); and an adhesion promoter (0.2%; Ken-React QB-012 from Kenrich Petrochemicals which consists of a 1:2 by weight mixture of titanium IV (bis-2-propendatomethyl)-1-butanolato, bis (dioctyl) pyrophosphato-0, adduct 3 moles N,N-dimethylamino alkyl propenoamide and zirconium IV 2,2-dimethyl-1,3-propanediolato, bis (dioctyl) prophosphato-0, adduct 2 moles N,N-dimethylamino alkyl propenoamide). The spray elastomeric material was first used to spot patch several areas where the mortar was missing. Approximately 10 pounds of reactants (about 5 pounds of each of the two reactants) were then sprayed applied to tile surfaces to be repaired. The temperature of the reactants was approximately 150° F. as sprayed. The entire interior surfaces of the manhole, including the block and mortar surfaces, frame, ladder rungs, and a portion of the bench were coated with the elastomeric material to a thickness of about ⅛ inch, thereby forming a nonporous, homogeneous, monolithic liner. Rehabilitation took approximately 30 minutes. Water was then sprayed on the coated surfaces in order to evaluate the rehabilitation. Based on this evaluation, it appears that the manhole could be returned to service almost immediately.

EXAMPLE 2

Two 7-foot deep, 48-inch diameter brick catch basins in Milwaukee, Wis., were repaired using the method of this invention. Both catch basins were in poor condition with missing bricks and mortar. The catch basins were cleaned using essentially the same method as Example 1. Approximately 300 gallons of water were removed from one catch basin using a sump pump. The ambient temperature was about 90° F. The isocyanate reactant consisted of a quasi-prepolymer prepared by reacting an isocyanate (PAPI 94 from Dow Chemical) with a trihydroxyl-terminated ethylene oxide-capped polyether with a molecular weight of about 4500 (PolyG 85-36 from Olin Chemicals). The isocyanate and the polyether (67 to 33 weight ratio) were simply mixed together and allowed to react at about 110° F. for about 24 hours. The amine reactant consisted of a polymeric aliphatic triamine (35.0%; Jeffamine T-3000 from Texaco), a polymeric aliphatic diamine (20.0%; Jeffamine D-2000 from Texaco), and two aromatic diamines (25% of Ethacure 100 from Ethyl Corporation and 20% of Unilink 4100 from UOP). No adhesion promoter was used. The spray elastomeric material was first used to spot patch and fill large voids. The elastomeric material was then spray applied to the brick and mortar surfaces as well as the metal frames. The reactants, applied at temperature of about 150° F., were mixed directly in the spray gun. The coating was applied to a thickness of approximately ¼ inch. Rehabilitation was completed in approximately 15 minutes and required about 8 to 9 gallons of spray elastomer (about 4 to 4.5 gallons of each reactant) for each basin.

EXAMPLE 3

A sprayable elastomeric material was prepared using the following reactants. The isocyanate reactant consisted of a quasi-prepolymer prepared by reacting an isocyanate (PAPI 94 from Dow Chemical) with a trihydroxyl-terminated ethylene oxide-capped polyether with a molecular weight of about 4500 (PolyG 85-36 from Olin Chemicals). The isocyanate and the polyether (67 to 33 weight ratio) were simply mixed together and allowed to react at 110° F. for about 24 hours. The amine reactant consisted of a polymeric aliphatic triamine (34.8%; Jeffamine T-3000 from Texaco), a polymeric aliphatic diamine (20.0%; Jeffamine D-2000 from Texaco), two aromatic diamines (25% of Ethacure 100 from Ethyl Corporation, and 20% of Unilink 4100 from UOP); and a titanate adhesion promoter (0.2%; Ken-React LICA 97 from Kenrich Petrochemicals). Combining the isocyanate reactant and the amine reactant in spray gun resulted in a fast-curing, elastomeric material suitable for use in repairing and rehabilitating manhole structures.

EXAMPLE 4

Another sprayable elastomeric material was prepared using the following reactants. The isocyanate reactant consisted of a quasi-prepolymer prepared by reacting a monomeric methylene diphenyl diisocyanate have a relatively high proportion of the 2,4'-isomer (Mondur 1424 from Mobay Corporation) with a trihydroxyl-terminated ethylene oxide-capped polyether with a molecular weight of about 4500 (PolyG 85-36 from Olin Chemicals). The isocyanate and the polyether (50 to 50 weight ratio) were simply mixed together and allowed to react at 110° F. for about 24 hours. The amine reactant consisted of a polymeric aliphatic diamine (64.9%; Jeffamine D-2000 from Texaco), two aromatic diamines (20% of Ethacure 100 from Ethyl Corporation and 15% of Unilink 4200 from UOP); and a titanate adhesion promoter (0.1%; Ken-React LICA 97 from Kenrich Petrochemicals). Combining the isocyanate reactant and the amine reactant in spray gun resulted in a fast-curing, elastomeric material suitable for use in repairing and rehabilitating manhole structures. The elastomeric material produced from this example is expected to have better low temperature performance (i.e., thermal cycling) than the material described in Example 3.

EXAMPLE 5

Another sprayable elastomeric material was prepared using the following reactants. The isocyanate reactant consisted of a quasi-prepolymer prepared by reacting a monomeric methylene diphenyl diisocyanate have a relatively high proportion of the 2,4'-isomer (Mondur 1424 from Mobay Corporation) with a trihydroxyl-terminated ethylene oxide-capped polyether with a molecular weight of about 4500 (PolyG 85-36 from Olin Chemicals). The isocyanate and the polyether (50 to 50 weight ratio) were simply mixed together and allowed to react at 110° F. for about 24 hours. The amine reactant consisted of two polymeric aliphatic diamines (64.9% of Jeffamine D-2000 and 5.0% of Jeffamine D-230, both from Texaco), two aromatic diamines (18% of Ethacure 100 from Ethyl Corporation and 12% of Unilink 4200 from UOP); and a titanate adhesive promoter (0.1%; Ken-React LICA 97 from Kenrich Petrochemicals). The Jeffamine D-230 diamine is an amine-terminated polypropylene glycol with a molecular weight of about 230. Combining the isocyanate reactant and the amine reactant in spray gun resulted in a fast-curing, elastomeric material suitable for use in repairing and rehabilitating manhole structures. The elastomeric material produced from this example is expected to be faster curing than the material described in Example 3.

That which is claimed is:

1. A method for lining or relining an existing engineering structure to rehabilitate, reinforce, and protect the engineering structure, said method comprising (1) preparing the surface of the engineering structure to be lined or relined by cleaning the brick, tile, concrete block, concrete, mortar, or metal forming the surface and removing loose particles of brick, tile, concrete block, concrete, mortar, or foreign material from the surface;

(2) applying a fast-curing elastomeric material to the prepared surface of the engineering structure to be lined or relined by spraying the fast-curing elastomeric material onto the prepared surface whereby a monolithic, continuous elastomeric coating is formed on the prepared surface, wherein the fast-curing elastomeric material is an isocyanate-initiated compound prepared by rapidly mixing and initiating the reaction of an isocyanate-terminated compound having at least two reactive isocyanate groups and an amine-terminated compound having at least two reactive amine groups immediately before spraying the fast-curing elastomeric material onto the prepared surface;

(3) allowing the fast-curing elastomeric coating to cure, whereby an elastomeric liner is formed on the prepared surface to rehabilitate, reinforce, and protect the engineering structure.

2. A method as defined in claim 1, wherein the engineering structure is a manhole and the surface to be lined or relined is the interior of the manhole, said method comprising spraying said isocyanate initiated elastomeric material on said interior manhole wall.

3. A method as defined in claim 2, wherein the manhole has steps providing access to the interior of the manhole and said method including spraying said fast-curing elastomeric material to said steps.

4. A method as defined in claim 1, wherein the isocyanate-terminated compound has a mean functionality of about 2.0 to 3.2 and about 15 to 35 weight percent isocyanate groups and wherein the amine-terminated compound has a mean functionality of about 2.0 to 3.0 and an average molecular weight of about 150 to 6000, said method including spraying said isocyanate initiated compound on said prepared surface.

5. A method as defined in claim 4, wherein the isocyanate-terminated compound is a monomeric or polymeric methylene diphenyl diisocyanate or a mixture of monomeric or polymeric methylene diphenyl diisocyanates of general formula

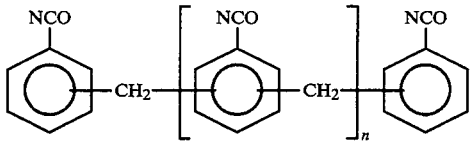

where n is an integer from 0 to about 10, said method including rapidly mixing said isocyanate-terminated compound with said amine-terminated compound and spraying said polyurea elastomeric material on said prepared surface.

6. A method as defined in claim 5, wherein n is an integer from 0 to about 4, said method including spraying said polyurea elastomeric material on said prepared surface.

7. A method as defined in claim 4, wherein the isocyanate-terminated compound is a quasi-prepolymer or mixture of quasi-prepolymers of general formula

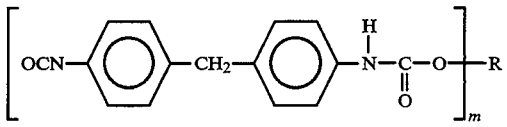

or of general formula

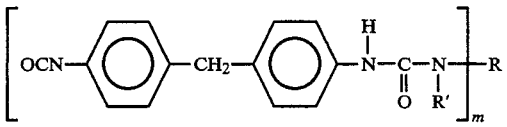

where m is equal to 2 or 3, R′ is a hydrogen or an aliphatic radical, and R is an aliphatic polyether, said method including rapidly mixing said isocyanate-terminated compound with said amine terminated compound and immediately spraying said polyurea elastomeric material on said prepared surface.

8. A method as defined in claim 4, wherein the amine-terminated compound is aliphatic amine-terminated polymer or a mixture of aliphatic amine terminated polymers of general formula

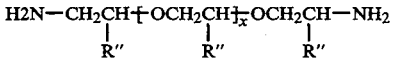

where each R″ is independently hydrogen or a methyl radical and x is in the range of about 0 to about 100, said method including rapidly mixing said isocyanate-terminated compound with said amine terminated compound and immediately spraying said polyurea elastomeric material on said prepared surface.

9. A method as defined in claim 4, wherein the amine-terminated compound ia aliphatic amine-terminated polymer or a mixture of aliphatic amine terminated polymers of general formula

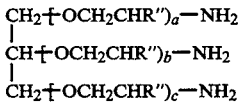

where R″ is hydrogen or a methyol radical and a, b, and c are independently in the range of about 0 to about 100 and such that the average molecular weight is in the range of about 260 to about 6000, said method including rapidly mixing said isocyanate-terminated compound with said amine terminated compound and immediately spraying said polyurea elastomeric material on said prepared surface.

10. A method as defined in claim 4, wherein the amine-terminated compound is an aliphatic or aromatic diamine, said method including rapidly mixing said isocyanate-terminated compound with said amine terminated compound and immediately spraying said polyurea elastomeric material on said prepared surface.

11. A method as defined in claim 10, wherein the amine-terminated compound is an aromatic diamine selected from the group consisting of 3,5-diethyltoluene-2,4-diamine, 3,5-diethyltoluene-2,6-diamine,para-di(N-alkyl)amine benzene, and 4,4′-methylene diphenyl di(N-alkyl)amine, and mixtures thereof, said method including rapidly mixing said isocyanate-terminated compound with said amine terminated compound and immediately spraying said polyurea elastomeric material on said prepared surface.

12. A method as defined in claim 1, wherein the fast-curing elastomeric material contains an effective amount of at least one additive selected from the group consisting of dyes, colorants, light stabilizers, UV absorbers, anti-oxidants, and adhesion promoters, where the additive is compatible with the fast-curing elastomeric material, said method including rapidly mixing said isocyanate-terminated compound with said amine terminated compound and immediately spraying said polyurea elastomeric material on said prepared surface.

13. A method as defined in claim 4, wherein the fast-curing elastomeric material contains an effective amount of at least one additive selected from the group consisting of dyes, colorants, light stabilizers, UV absorbers, anti-oxidants, and adhesion promoters, where the additive is compatible with the fast-curing elastomeric material, said method including rapidly mixing said isocyanate-terminated compound with said amine terminated compound and immediately spraying said polyurea elastomeric material on said prepared surface.

14. A lined manhole forming a portion of a sanitary or non-sanitary sewer system and buried below ground layer, said lined manhole comprising (1) a housing with an interior surface formed of brick, tile, concrete block, concrete, or mortar having an interior space to allow human access to a buried conduit forming a portion of the sanitary or non-sanitary sewer system wherein the housing is adapted to be buried in the ground; and (2) a sprayed polyurea elastomeric liner within the interior of the housing forming an essentially continuous, non-porous, monolithic liner formed in place and substantially conforming to the geometry of the interior of the housing, wherein the sprayed elastomer liner is formed from a fast-curing polyurea elastomeric material sprayed onto the interior surface of the housing and wherein the fast-curing elastomeric material is the reaction product of an isocyanate-terminated compound and an amine-terminated compound.

15. A lined manhole as defined in claim 14, wherein the manhole has metal steps providing access to the interior of the manhole and the sprayed elastomer liner also covers the metal steps.

16. A lined manhole as defined in claim 14, wherein the isocyanate-terminated compound has a mean functionality of about 2.0 to 3.2 and about 15 to 35 weight percent isocyanate groups and wherein the amine-terminated compound has a mean functionality of about 2.0 to 3.0 and an average molecular weight of about 150 to 6000.

17. A lined manhole as defined in claim 16, wherein the isocyanate-terminated compound is a monomeric or polymeric methylene diphenyl diisocyanate or a mixture of monomeric or polymeric methylene diphenyl diisocyanates of general formula

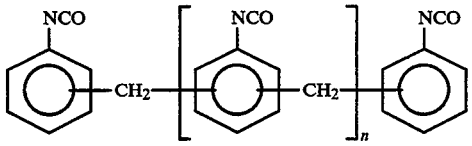

where n is an integer from 0 to about 10.

18. A lined manhole as defined in claim 16, wherein n is an integer from 0 to about 4.

19. A lined manhole as defined in claim 16, wherein the isocyanate-terminated compound is a quasi-prepolymer or mixture of quasi-prepolymers of general formula

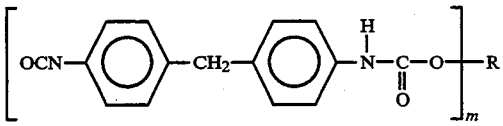

or of general formula

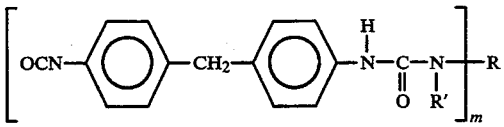

where m is equal to 2 or 3, R′ is a hydrogen or an aliphatic radical, and R is an aliphatic polyether.

20. A lined manhole as defined in claim 16, wherein the amine-terminated compound is aliphatic amine-terminated polymer or a mixture of aliphatic amine terminated polymers of general formula

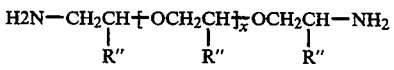

where each R″ is independently hydrogen or a methyl radical and x is in the range of about 0 to about 100.

21. A lined manhole as defined in claim 16, wherein the amine-terminated compound is aliphatic amine-terminated polymer or a mixture of aliphatic amine terminated polymers of general formula

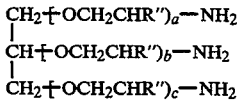

where R″ is hydrogen or a methyl radical and a, b, and c are independently in the range of about 0 to about 100 and such that the average molecular weight is in the range of about 260 to about 6000.

22. A lined manhole as defined in claim 16, wherein the amine-terminated compound is an aliphatic or aromatic diamine.

23. A lined manhole as defined in claim 20, wherein the amine-terminated compound is an aromatic diamine selected from the group consisting of 3,5-diethyltoluene-2,4-diamine, 3,5-diethyltoluene-2,6-diamine, para-di(N-alkyl)amine benzene, and 4,4′-methylene diphenyl di(N-alkyl)amine, and mixtures thereof.

24. A lined manhole as defined in claim 14, wherein the fast-curing elastomeric material contains an effective amount of at least one additive selected from the group consisting of dyes, colorants, light stabilizers, UV absorbers, anti-oxidants, and adhesion promoters, where the additive is compatible with the fast-curing elastomeric material.

25. A lined manhole as defined in claim 16, wherein the fast-curing elastomeric material contains an effective amount of at least one additive selected from the group consisting of dyes, colorants, light stabilizers, UV absorbers, anti-oxidants, and adhesion promoters, where the additive is compatible with the fast-curing elastomeric material.

* * * * *

UNITED STATES PATENT AND TRADEMARK OFFICE

CERTIFICATE OF CORRECTION

PATENT NO. : 5,405,218

DATED : April 11, 1995

INVENTOR(S) : Hyde-Smith, Peter K.

It is certified that error appears in the above-indentified patent and that said Letters Patent is hereby corrected as shown below:

Claim 1, column 14, line 29, after "fast-curing" insert --polyurea--

Claim 2, column 14, line 50, after "initiated" insert --polyurea--

Claim 4, column 14, line 62, after "initiated" insert --polyurea--

Signed and Sealed this

Thirtieth Day of January, 1996

Bruce Lehman

*Attest:*

BRUCE LEHMAN

*Attesting Officer*

*Commissioner of Patents and Trademarks*

Disclaimer 5,405,218—Peter K. Hyde-Smith, Mayville, Mich. METHOD FOR THE REPAIR OF EXISTING MANHOLES USING ELASTOMERIC MATERIALS. April 11, 1995. Disclaimer filed December 31, 2001, by the assignee, Illinois Tool Works Inc.

Hereby disclaims and dedicates to the public claims 1-13.

(*Official Gazette, March 26, 2002.*)